United States Patent [19]

Maejima et al.

[11] 4,368,107

[45] Jan. 11, 1983

[54] METHOD OF SURFACE TREATMENT OF POROUS MATERIAL

[75] Inventors: Masatsugu Maejima; Koichi Saruwatari; Kazuo Isawa, all of Tokyo, Japan

[73] Assignee: Fujikura Cable Works, Ltd., Tokyo, Japan

[21] Appl. No.: 272,658

[22] Filed: Jun. 11, 1981

[30] Foreign Application Priority Data

Jun. 16, 1980 [JP] Japan ..... 55-81051

[51] Int. Cl.[3] ..... C25D 5/00; C25D 5/34; C25D 5/48; C25D 5/50

[52] U.S. Cl. ..... 204/24; 204/29; 204/35 R; 204/37 R; 204/38 R; 204/41; 204/42

[58] Field of Search ..... 204/24, 40, 42, 41, 204/37 R, 29, 35 R, 38 R

[56] References Cited

U.S. PATENT DOCUMENTS

| | | | |
|---|---|---|---|
| 4,039,399 | 8/1977 | Wallace | 204/41 |
| 4,094,749 | 6/1978 | Stange | 204/37 R |
| 4,204,918 | 5/1980 | McIntyre | 204/24 |
| 4,230,539 | 10/1980 | Saruwatari | 204/37 R |

*Primary Examiner*—T. Tufariello
*Attorney, Agent, or Firm*—Darby & Darby

[57] ABSTRACT

A method of the surface treatment of a porous material which comprises the step of electrolyzing the porous material in an electrolytic bath composed of an aqueous solution of at least one salt selected from the group consisting of alkali metal thiotungstate, alkali metal thioantimonate, alkali metal thiostannate, alkali metal thiocuprate, alkali metal thioarsenate, alkali metal thioaurate, alkali metal thioplatinate, alkali metal thioniobate, alkali metal thiovanadate, alkaline earth metal thiotungstate, alkaline earth metal thioantimonate, alkaline earth metal thiostannate, alkaline earth metal thiocuprate, alkaline earth metal thioarsenate, alkaline earth metal thioaurate, alkaline earth metal thioplatinate, alkaline earth metal thioniobate, alkaline earth metal thiovanadate, ammonium thiotungstate, ammonium thioantimonate, ammonium thiostannate, ammonium thiocuprate, ammonium thioarsenate, ammonium thioaurate, ammonium thioplatinate, ammonium thioniobate and ammonium thiovanadate, to thereby impregnate the porous material with the metallic sulfide. Optionally, the porous material may be immersed alternately in an aqueous solution prepared as described above for the electrolytic bath and an acid aqueous solution after the electrolysis to further impregnate the porous material with the metallic sulfide.

32 Claims, No Drawings

METHOD OF SURFACE TREATMENT OF POROUS MATERIAL

BACKGROUND OF THE INVENTION

1. Field of the Invention

This invention relates to a method of the surface treatment of a porous material.

2. Prior Art

In the remainder of the description, the term "porous material" denotes a porous metal material or a material having a porous metal surface.

Conventionally, the pores of a porous material, such as aluminium having an anodic oxide film or a sintered alloy, are filled or impregnated with a solid lubricant such as powder of molybdenum disulfide, powder of tungsten disulfide powder of polyfluoroethylene or colloidal carbon to lower a coefficient of friction of the surface to improve lubricating properties thereof. The porous material so treated is used as machine component parts, which require high wear resistance, such as a bearing member. One method of filling the solid lubricant is known in which the porous material is immersed in a solid lubricant in the form of powder. Another filling method is also known in which a powder lubricant is dispersed in a liquid to provide a dispersion in which the porous material is immersed. These filling methods have been found not satisfactory in that the powder lubricant fails to be adequately filled in the pores of the porous material in the case where the pores do not have an adequate size or have a complicated shape. For example, the diameter of the micropores of the anodic oxide film of aluminum is very small and is on the order of 100 to 500 Å, and it is almost impossible to fully fill the micropores with a powder lubricant of molybdenum disulfide. In addition, the micropores have a depth of 10 to 200μ which is greater in comparison with its diameter, and therefore the powder lubricant can be filled only in that portion of each micropores near its opening. This is undesirable in that the porous material so treated, when used as a wear resistant material, can not maintain required wear resistant properties for a prolonged period of time.

SUMMARY OF THE INVENTION

It is therefore an object of this invention to provide a method of the surface treatment of a porous material in which a solid lubricant of metallic sulfide is fully filled in the micropores of the porous material so that the surface of the porous material has improved lubricating properties such as a lower coefficient of friction, a higher load resistance and a reduced tendency of cohesion.

According to the invention, there is provided a method of the surface treatment of a porous material which comprises the step of electrolysing the porous material in an aqueous solution of at least one salt selected from the group consisting of alkali metal thiotungstate, alkali metal thioantimonate, alkali metal thiostannate, alkali metal thiocuprate, alkali metal thioarsenate, alkali metal thioaurate, alkali metal thioplatinate, alkali metal thioniobate, alkali metal thiovanadate, alkaline earth metal thiotungstate, alkaline earth metal thioantimonate, alkaline earth metal thiostannate, alkaline earth metal thiocuprate, alkaline earth metal thioarsenate, alkaline earth metal thioaurate, alkaline earth metal thioplatinate, alkaline earth metal thioniobate, alkaline earth metal thiovanadate, ammonium thiotungstate, ammonium thioantimonate, ammonium thiostannate, ammonium thiocuprate, ammonium thioarsenate, ammonium thioaurate, ammonium thioplatinate, ammonium thioniobate and ammonium thiovanadate, thereby to impregnate the porous material with the metallic sulfide. Optionally, the porous material may be subjected to a heat treatment, a dehydrating treatment or a drying treatment after the electrolysis. Also, the porous material may be immersed alternately in an aqueous solution of at least one metal salt of thio-acid prepared as described above for the electrolysis and an acid aqueous solution after the above-mentioned electrolysis. After this alternate immersion treatment, the porous material may be subjected to a heat treatment.

DETAILED DESCRIPTION OF THE INVENTION

The porous material used in the present invention includes a porous metal material of which entire structure is porous, such as a porous sintered alloy, and a porous sintered material prepared by aluminium powder and not more than 10% by weight of at least one powder material with a particle size of not more than 100μ which is selected from the group consisting of $MoS_2$, $WS_2$, PbS, graphite, graphite fluoride and BN, a cast aluminium composite, and a material having a porous metal surface. The material having the porous metal surface includes a porous chromium-plated metal, a microcrack-plated metal, aluminium, tantalum, titanium and their alloys (for example, an aluminium alloy containing 0.1 to 20% by weight Mo, W and 8 to 25% by weight Pb, Sn) having an anodic oxide film, a ceramic or plastic material treated by electroless plating and then porous chronium plating or microcrack plating, and an electroless-plated porous ceramic or plastic material. The above mentioned porous materials are electrolysed in an aqueous solution (hereinafter referred to as electrolytic bath) of at least one salt selected from the group consisting of alkali metal thiotungstate, alkali metal thioantimonate, alkali metal thiostannate, alkali metal thiocuprate, alkali metal thioarsenate, alkali metal thioaurate, alkali metal thioplatinate, alkali metal thioniobate, alkali metal thiovanadate, alkaline earth metal thiotungstate, alkaline earth metal thioantimonate, alkaline earth metal thiostannate, alkaline earth metal thiocuprate, alkaline earth metal thioarsenate, alkaline earth metal thioaurate, alkaline earth metal thioplatinate, alkaline earth metal thioniobate, alkaline earth metal thiovanadate, ammonium thiotungstate, ammonium thioantimonate, ammonium thiostannate, ammonium thiocuprate, ammonium thioarsenate, ammonium thioaurate, ammonium thioplatinate, ammonium thioniobate and ammonium thiovanadate, thereby to impregnate or fill the porous material with the metallic sulfide. The porous material may be subjected to a pretreatment before the electrolysis.

As a pretreatment, the surface of the porous material is activated by an acid. The porous material is immersed in an aqueous solution of inorganic acid such as nitric acid, phosphoric acid, boric acid, sulfuric acid and hydrochloric acid or organic acid such as oxalic acid, formic acid, acetic acid and malonic acid, or in an aqueous solution of at least one salt of these acids dissolved therein. With this pretreatment, the porous material can be electrolysed in the electrolytic bath in a more stable manner.

As another pretreatment, the porous material is immersed in an alkaline aqueous solution such as an aqueous solution of sodium hydroxide, potassium hydroxide, sodium carbonate or sodium phosphate, or ammonia water so as to activate the surface of the porous material. Also, the porous material may be electrolysed in an alkaline aqueous solution to activate its surface and to enlarge the pores, the porous material serving as a cathode. With these methods, the subsequent electrolysis can be carried out in a stable manner so that a greater amount of metallic sulfide is filled in the pores.

It is also useful as a pretreatment to maintain the porous material under a subatmospheric pressure or vacuum and to remove volatile components from the pores.

The porous material may be electrolysed in an aqueous solution of a salt of metal such as nickel, tin, copper, manganese, cadmium, titanium, chromium, zinc, silver, gold and vanadium, or a salt of oxyacid. Particularly, when the porous material is electrolysed in an aqueous solution of a metal salt, such as nickel sulfate, tin sulfate and copper sulfate, to deposite the metal in the pores, or when the porous material is electrolysed in an aqueous solution of oxyacid, such as molybdic acid, tungstic acid and stannic acid, or a salt of these acids so as to impregnate the pores with a compound of these metals, these metal and metal compounds also produce metallic sulfides at the time when the secondary electrolysis is carried out using the aqueous solution of at least one metal salt of thio-acid. Thus, the metallic sulfide can be efficiently filled in the pores of the porous material.

Also, metal or metal compound can be filled in the pores of the porous material in different manners as a pretreatment. One method is to immerse the porous material in an aqueous solution of a salt of acid such as chromic acid. Another method is to immerse the porous material alternately in two solutions of the nature that can produce metal compound. In these cases, the metal compound produces metallic sulfide at the time when the subsequent electrolysis is carried out using the aqueous solution of at least one metal salt of thio-acid.

Further, as a pretreatment, a semi-sealing process may be carried out to reduce the size of the pores of the porous material so that the subsequent electrolysis can be carried out in shorter time or requires less electrolysis current to fully fill the so-treated pores with the metallic sulfide. However, such a semi-sealing process is applicable particularly to the material having an anodic oxide film. The semi-sealing treatment is carried out by the following procedures (a) to (e):

(a) A material with an anodic oxide film is immersed in a boiling or hot desalted water so that the micropores of the anodic oxide film are filled with aluminium hydrate to reduce the size of the micropores.

(b) At least one of nickel acetate, a salt of bichromic acid and silicate of soda is added to a desalted water prepared according to the procedure (a), and a material with an anodic oxide film is immersed in such a desalted water. With this method, the size of the micropores is reduced by the formation of aluminium hydrate and the deposition or adsorption of nickel hydroxide or a compound of bichromic acid or silicic acid. This method is advantageous in that the semi-sealing treatment can be carried out in shorter time in comparison with the above procedure (a).

(c) An organic dye is dissolved in a desalted water prepared according to procedures (a) or (b), and a material with an anodic oxide film is immersed in such a desalted water. With this method, the micropores of the anodic oxide film is semi-sealed as described above in procedure (a) or (b), and besides the anodic oxide film is subjected to dyeing.

(d) A material with an anodic oxide film is placed in an atmosphere of steam under pressure (for example, 1 to 6 kg/cm$^2$). With this method, the micropores of the anodic oxide film are filled with metal hydrate as is the case with procedure (a). This method is advantageous in that the metal hydrate is deposited or adsorbed substantially uniformly over the whole of the micropores, i.e., from the bottom to the opening thereof.

(e) A material with an anodic oxide film is subjected to an alternating current electrolysis in an aqueous solution of calcium carbonate or magnesium carbonate. With this method, a cement-like material is formed in the micropores of the anodic oxide film to reduce the size thereof. This method is advantageous in that the semi-sealing treatment is carried out in shorter time.

The pores of the porous material may be enlarged so that a greater amount of metallic sulfide is filled in the pores to impart better lubricating properties to the surface. This enlarging treatment is carried out by the following procedures (a) to (d):

(a) The porous material is immersed in an aqueous solution of alkali material such as caustic soda, caustic potash, sodium carbonate, sodium phosphate or ammonia water. With this method, the surface of the pores is slightly dissolved so that the pores are enlarged and that the surface is activated. Further, since the porous material is treated in the alkaline solution, the speed of dissolution of the pore surface is high so that the enlarging treatment can be advantageously carried out in short time.

(b) The porous material is subjected to a direct current electrolysis in an alkaline solution prepared according to procedure (a), the porous material serving as a cathode. With this method, the electrolysis is carried out and therefore the enlargement of the pores is effected efficiently as is the case with procedure (a).

(c) The porous material is subjected to a heat treatment or a honing treatment so that fine cracks are formed in the porous surface. A greater amount of metallic sulfide can be filled in the pores of the porous material because of the presence of the fine cracks. In the case where this procedure is applied to the material with the anodic oxide film, no dissolution of the film occurs so that the enlarging treatment is carried out without reducing the mechanical strength of the film.

(d) The porous material is subjected to a subatmospheric pressure or vacuum to volatilize volatile components from the pores in the surface of the porous material. With this method, a greater amount of metallic sulfide can be filled in the pores because of the removal of the volatile components. This procedure can advantageously be carried out easily in comparison with procedures (a) to (c).

Further, as a pretreatment, the pores in the surface of the porous material may be dyed by an organic dye. With this dyeing treatment, the porous material has a predetermined color tone. This dyeing treatment is suitably applied to the porous material which is used as a wear resistant member requiring a pleasing appearance. Any organic dye may be used, but since the color of the metallic sulfide, deposited in the pores at the subsequent electrolysis, is black or brown, it is preferred that a dye of black or brown is used. It is also preferred that the pH of a dyeing solution is adjusted to 5 to 8.

The reason is that the impregnation of the metallic sulfide is not adequately carried out at the subsequent electrolysis when the dyeing solution has pH other than the value mentioned above. The porous material may be activated by acid such as nitric acid after the dyeing treatment. With this activation treatment, the porous material has a deeper color, and is dyed uniformly.

The porous material may be subjected to the above-mentioned pretreatments as necessary. Then, the porous material is electrolysed in an aqueous solution of at least one metal salt of thio-acid as described above. The electrolysis conditions are now described in the followings:

The electrolytic bath is prepared by dissolving in water at least one salt selected from the group consisting of alkali metal thiotungstate, alkali metal thioantimonate, alkali metal thiostannate, alkali metal thiocuprate, alkali metal thioarsenate, alkali metal thioaurate, alkali metal thioplatinate, alkali metal thioniobate, alkali metal thiovanadate, alkaline earth metal thiotungstate, alkaline earth metal thioantimonate, alkaline earth metal thiostannate, alkaline earth metal thiocuprate, alkaline earth metal thioarsenate, alkaline earth metal thiourate, alkaline earth metal thioplatinate, alkaline earth metal thioniobate, alkaline earth metal thiovanadate, ammonium thiotungstate, ammonium thioantimonate, ammonium thiostannate, ammonium thiocuprate, ammonium thioarsenate, ammonium thioaurate, ammonium thioplatinate, ammonium thioniobate and ammonium thiovanadate. Particularly, when the salts of thiotungstic acid or thiostannic acid are used, marked lubricating properties are achieved. The concentration of the metal salt or salts is preferably 0.01 to 30% by weight. When a water-soluble organic solvent such as methanol, ethanol and methyl ethyl ketone or a surface active agent is added to the electrolytic bath, the surface tension of the electrolytic bath is decreased so that the solute can be introduced into the pores more efficiently.

The pH of the electrolytic bath is usually adjusted to between 4 and 12. The pH is adjusted by the addition of inorganic acid, organic acid, a salt of these acids, or an alkaline material. However, the amount of such an additive should be kept to a minimum. Water used for the electrolytic bath is preferably a desalted water, and the introduction of impurities and particularly a strong electrolytic material into the electrolytic bath should be avoided. When the electrolytic bath is heated, the speed of electrolytic reaction is increased. Subsequently, the porous material which has been degreased and washed is electrolysed. A suitable electrically conductive material is used as the opposite pole. As the electrolysis current, D.C. and a periodical current such as incompletely rectified current, superposed A.C. and D.C. current, alternately acting A.C. and D.C. current, A.C., pulsed current, rectangular current, and triangular current. The temperature of the electrolyte is maintained at between 0° C. to 100° C. during the electrolysis. When the direct current electrolysis is used, it is preferred that current density is 10 $mA/dm^2$ to 1 $A/dm^2$ and that the electrolysis time is 1 minute to 1 hour. The reason that the metallic sulfide is produced as a result of the electrolysis using the above-mentioned electrolytic bath is thought as follows: The metal salt of thio-acid is dissociated in the aqueous solution to produce negatively charged thio-acid ions. When the porous material serves as the positive electrode during the electrolysis, the thio-acid ions move into the pores by the electrophoresis. On the other hand, the electrode reaction ($OH^- \rightarrow \frac{1}{2} O_2 + H^+ + 2e$) takes place in the bottom of the pores. As a result, $H^+$ is released and therefore the pH in the pores becomes acid. The thio-acid ions are decomposed to produce metallic sulfide which is deposited on the surface of the pores. The deposition of the metallic sulfide begins from the bottom of the pores from which $H^+$ is released, and then proceeds toward the opening of the pores. It is also thought that in addition to the above reaction, the thio-acid ions of the metal directly bring above the electrolysis reaction to deposit the metal sulfide on the surface of the pores. $H_2S$, $HS^-$, $S^{2-}$, S produced by the above reaction react with the metals and metal compounds (introduced into the pores by the above-mentioned pretreatments) present in the surface of the porous material and in the pores to produce the metallic sulfide which is positively deposited on the surface of the pores and the surface of the porous material. When a sufficient amount of metallic sulfide is filled in the pores, the electrolysis is stopped, and the treated porous material is rinsed in water to remove the electrolyte and the reaction by-products therefrom. Then, in order to remove the moisture from the surface and the pores, the porous material is immersed in a water-soluble organic solvent such as methanol, ethanol and acetone to be dewatered. Alternatively, the porous material is air-dried or dried at temperatures ranging from a room temperature to about 200° C. With these drying treatments, the porous material having lubricating properties according to the invention is sufficiently dried to serve its purpose. The filled metallic sulfide may be further subjected to a heat treatment at temperatures of 200° to 800° C. to promote its crystallinity. This treatment is carried out if necessary. The dehydrated or dried porous material is immersed alternately in an aqueous solution of thio-acid metal salt and an acid aqueous solution (this treatment is hereinafter referred to as the alternate immersion treatment). With this alternate immersion treatment, the metallic sulfide is produced and filled in the pores of the porous material. The metallic sulfide is impregnated from the bottom toward the opening of the pores during the above-mentioned electrolysis using the aqueous solution of at least one metal salt of thio-acid. On the other hand, the metallic sulfide is impregnated from the opening to the bottom of the pores during the alternate immersion treatment. Therefore, when the alternate immersion treatment is carried out after the electrolysis, the metallic sulfide impregnated in the pores by the electrolysis will not prevent the metallic sulfide, produced by the alternate immersion treatment from being impregnated in the pores. Thus, the pores can be efficiently filled with the metallic sulfide. The alternate immersion treatment may be carried out as a pretreatment before the electrolysis.

One of the two immersion solutions is prepared by dissolving in an aqueous solution at least one salt selected from the group consisting of a alkali metal thiotungstate, alkali metal thioantimonate, alkali metal thiostannate, alkali metal thiocuprate, alkali metal thioarsenate, alkali metal thioaurate, alkali metal thioplatinate, alkali metal thioniobate, alkali metal thiovanadate, alkaline earth metal thiotungstate, alkaline earth metal thioantimonate, alkaline earth metal thiostannate, alkaline earth metal thiocuprate, alkaline earth metal thioarsenate, alkaline earth metal thioaurate, alkaline earth metal thioplatinate, alkaline earth metal thioniobate, alkaline earth metal thiovanadate, ammonium thiotungstate, ammonium thioantimonate, ammonium thiostannate, ammonium thiocuprate, ammonium thioarsenate, ammonium thioaurate, ammonium thioplatinate, ammonium thioniobate and ammonium thiovanadate. Inorganic acid, organic acid or alkaline material may be added to the aqueous solution to adjust its pH to 5 to 12 so that the stabilization of the aqueous solution is improved and that the speed of production of the metallic sulfide is appropriate. Particularly, the salts of thiotungstic acid and thiostanic acid are preferred. The other immersion solution is prepared by dissolving in an aqueous solution at least one material selected from the group consisting of nitric acid, phosphoric acid, boric acid, sulfuric acid, hydrochloric acid, sulfamic acid, chromic acid, oxalic acid, formic acid, acetic acid, malonic acid, succinic acid, maleic acid, citric acid, tartaric acid, phthalic acid, itaconic acid, malic acid, glycolic acid, sulfosalicylic acid, and one or more salts of these inorganic and organic acids. The pH of the solution is adjusted to below 4. The porous material is immersed alternately in the two solutions so that various metallic sulfides can be produced and impregnated in the pores of the porous material. When the sulfide of lead is to be impregnated in the pores, it is preferred that an aqueous solution of lead acetate and an aqueous solution of ammonium sulfide are prepared. The porous material is then immersed alternately in these two solutions. As mentioned above, the metallic sulfides produced by the alternate immersion treatment are impregnated from the opening toward the bottom of the pores. Therefore, the alternate immersion treatment cooperates with the electrolysis using the aqueous solution of at least one metal salt of thio-acid so as to fully fill the pores with the metallic sulfides.

The alternate immersion treatment is explained more specifically. When the porous material is immersed in the aqueous solution of at least one metal salt of thio-acid, the ions of the thio-acid move into the pores by the diffusion. In this case, the required immersion time is 1 to 10 minutes. A water-soluble organic solvent such as methanol, ethanol and acetone or a surface active agent may be added to the immersion solution to decrease the surface tension of the immersion surface. As a result, the solute can be efficiently introduced into the pores of the porous material, and the immersion time is shortened. The same is true with the acid immersion solution. The alternate immersion treatment is repeated, and each time one cycle of the alternate immersion treatment is completed, the porous material is rinsed in water to remove the by-products from the surface so that the metallic sulfide can be efficiently impregnated in the pores. The porous material which has been subjected to the alternate immersion treatment is rinsed in water to remove the immersion solution and the by-products. Subsequently, in order to remove the moisture from the surface and the pores, the porous material is subjected to a dehydrating treatment and, if necessary, to a heat treatment, as described above for the electrolysis. With this heat treatment, the metallic sulfide impregnated in the pores is converted from an amorphous form to a layerlike crystal structure. High lubricating properties are imparted to the porous material by this heat treatment. It is necessary to carry out the heat treatment in the absence of oxygen so that the metallic sulfide is not oxidized to form the metallic oxide. Preferably, the heating temperature is 200° to 800° C. When the heating treatment is carried out at excessively high temperatures, the metallic sulfide impregnated in the pores is sublimed to affect the porous material itself. Care should be taken in this respect. In the case where a material having low heat resistance such as a plastics material is used as a substrate for the porous material, the heat treatment naturally is not carried out. However, when the porous material to which the heat treatment is not applicable is used as a bearing member or the like, the metallic sulfide adjacent to the sliding surface or contact surface is changed by the frictional heat developed to have a layer-like crystal structure. As a result, the surface comes to have sufficient lubricating properties for practical use.

The porous material of which pores have been filled with the metallic sulfide may be surface-treated by a lubricating material. This surface treatment serves to fill the pores, not yet fully filled with the metallic sulfide, the cracks and the fine pits on the surface with the lubricating material. Also, the surface treatment serves to impart lubricating properties to the outer surface of the filled metallic sulfide and the surface of the porous material. The lubricating material is applied as by coating or filling. This surface treatment can be easily carried out, and a large amount of lubricating material can be applied to the porous material. The porous material surface-treated with the lubricating material, when used as a bearing member or the like, is advantageous in that the lubricating material enhances the initial lubricating properties at an initial stage of use when smooth sliding properties are not yet imparted to the bearing member. The surface treatment by the lubricating material is carried out by the following procedures (a), (b), (c) and (d):

(a) The porous material is immersed in a solution of fatty acid such as stearic acid, palmitic acid or oleic acid or spray-coated with such a solution so that the fatty acid is adsorpted or deposited on the surface of the porous material. Another method is to immerse the porous material in a hot molten fatty acid so that the fatty acid is adsorpted or deposited on the surface of the porous material. A further method is to carry out an abrasion operation such as a buffing operation using powder of the fatty acid or an abrasive material containing the fatty acid, so that the fatty acid is adsorpted or deposited on the surface of the porous material.

(b) The porous material is immersed in a lubricating oil such as paraffin, machine oil, silicone oil, animal oil and vegetable oil, or in a solution prepared by additing such lubricating oil to a solvent, so that the lubricating oil is adsorpted or deposited on the surface of the porous material.

(c) Powder of molybdenum sulfide, tungsten sulfide, graphite, boron nitride, fluorocarbon or polyfluoroethylene is dispersed in an aqueous solution of a thermosetting resin such as epoxy resin or sodium silicate to prepare a dispersion in which the porous material is immersed. The powder has a particle size of not more than 100$\mu$. The porous material so treated is set by heat so that a layer containing the solid lubricating material is formed on the surface.

(d) A solid lubricating material such as molybdenum sulfide, tungsten sulfide, graphite, boron nitride and fluorocarbon is applied to the surface of the porous material by a buff or the like so that the lubricating material is adsorpted on the surface.

With the above-mentioned surface treatment using the lubricating material, the applied lubricating material and the metallic sulfide filled in the pores of the porous material cooperate to enhance the lubricating properties. This surface treatment by the lubricating material may be carried out prior to the above-mentioned heat treatment.

The surface of the porous material filled with the metallic sulfide may also be subjected to a grinding operation. This grinding operation serves to slightly grind the surface of the porous material so that the surface becomes smooth and that the properties of the metallic sulfide is changed. As a result, the sliding properties and wear resistance of the surface are enhanced. The amount of grinding of the surface by about 3μ is sufficient for its purpose. Particularly, the grinding operation can advantageously be applied to the porous material having a thick film of not less than 30μ. The grinding operation includes super finishing, honing, liquid honing, fine finishing grinding (cutting by a cutter) and buffing. This grinding operation is different from a rubbing treatment in which the surface is merely rubbed, and the grinding operation is to positively grind the surface. Therefore, in the case of the buffing, preferably, coarse abrasive grains are first used to grind the surface, and then a finish buffing is applied to the surface. With the grinding operation, the surface of the porous material becomes smooth to enhance sliding properties. In addition, the crystal structure of the metallic sulfide on the surface is changed by the heat generated during the grinding operation, and the lubricating properties are enhanced still more.

The porous material impregnated with the metallic sulfide may be subjected to a rubbing operation. The rubbing operation is carried out by rubbing repeatedly the surface of the porous material with soft material such as cloth, paper and leather. Also, the rubbing operation is effected by lapping, polishing or abrasion. With the rubbing treatment, the metallic sulfide is spread over the entire surface of the porous material to make the surface smooth, and is positively adhered to the surface. Further, when the metallic sulfide is repeatedly rubbed, the crystalline orientation becomes uniform so that the lubricating properties are markedly improved. Since the rubbing treatment can be carried out easily than the grinding operation, it is preferred that the porous material which requires the grinding operation is subjected to the rubbing treatment.

As described above, according to the present invention, an adequate amount of metallic sulfide having high lubricating properties can be impregnated or filled in the pores of the porous material, i.e., as far as the bottom of the pores. Therefore, the lubricating properties of the metallic sulfide are maintained until the surface of the porous material having the metallic sulfide is completely worn out. Further, in the case of the porous material subjected to the heat treatment, the metallic sulfide has the layer-like crystal structure, and therefore the lubricating properties are further improved. Further, in the case of the porous material of which surface is impregnated with the metallic sulfide and treated by the lubricating material, the initial lubricating properties are particularly enhanced. Further, in the case of the porous material subjected to the grinding operation, the surface becomes smooth, and the sliding properties are enhanced, and the lubricating properties are also enhanced. Various products made of the so-treated porous material are advantageous in that they have a low coefficient of friction, a high load resistance and a reduced tendency of cohesion whereby the surface is not subjected to scratch and seizure.

The invention will now be illustrated by the following examples:

EXAMPLE 1

2S aluminium plates (size: 10×10×0.1 cm) were prepared as test pieces. Each of the test pieces was degreased by an organic solvent, and then electrolyzed in an aqueous solution of 15% sulfuric acid for 30 minutes at 10° C. at a current density of 3 A/dm$^3$, so that an almite film of 30 μm thickness was formed on the surface of each test piece. Then, each of the test pieces was immersed in an aqueous solution of 10% nitric acid for 10 minutes to activate the surface. Then, the test pieces, serving as the positive electrode, were electrolyzed for 20 minutes by D.C. current (current density: 50 mA/dm$^2$) in aqueous solutions of 1% by weight potassium thioaurate, 1% ammonium thiotungstate, 1% ammonium thiostannate, 1% ammonium thioantimonate and 1% potassium thiocuprate, respectively. Then, the test pieces were rinsed in water and air-dried. The test pieces were heat-treated in nitrogen gas atmosphere at 400° C. for 30 minutes.

A static coefficient of friction of the heat treated test pieces and the test pieces not subjected to the heat treatment was then measured by an inclination method (the partner material was copper; the area of contact was 1 cm$^2$; the load was 2 g). The results obtained are given in Table 1.

TABLE 1

| | Kind of thio-acid metal salt | | | | |
|---|---|---|---|---|---|
| Treatment | Potassium thioaurate | Ammonium thiotungstate | Ammonium thiostannate | Ammonium thioantimonate | Potassium thiocuprate |
| No heat treatment | 0.34 | 0.34 | 0.45 | 0.48 | 0.50 |
| Heat treatment | 0.27 | 0.28 | 0.40 | 0.45 | 0.44 |

A static coefficient of friction of the almite film not subjected to the electrolysis in the aqueous solution of the metal salt of the thio-acid was 0.65.

EXAMPLE 2

90% by weight copper and 10% tin were sintered at 800° C. for 30 minutes to prepare sintered alloys as test pieces of which porosity was 15%. The test pieces were degreased and cleaned by trichloroethylene. The test pieces, serving as the positive electrode, were electrolyzed for 10 minutes by D.C. current (current density: 0.5 A/dm$^2$) in aqueous solutions of 1% by weight ammonium thioarsenate, 1% ammonium thiotungstate, 1% ammonium thioantimonate, 1% ammonium thiostannate, 1% potassium thiocuprate, and 1% ammonium thioaurate, respectively. Then, the test pieces were rinsed in water and dehydrated by absolute alcohol and air-dried. The test pieces were heat-treated in nitrogen gas atmosphere at 200° C. for 30 minutes. The sintered alloy which was not subjected to the above treatment was used as a comparison test piece. An abrasion test was carried out with respect to the test pieces. The abrasion test conditions were as follows:

| | |
|---|---|
| Partner material: | Copper |
| Load: | 5 kg/cm$^2$ |
| Abrasion speed: | 10 m/min. |
| Abrasion time: | 1 hour |

The results obtained are given in Table 2.

TABLE 2

| | | Kind of thio-acid metal salt | | | | | | | | | | | |
|---|---|---|---|---|---|---|---|---|---|---|---|---|---|
| | | Ammonium thioarsenate | | Ammonium thiotungstate | | Ammonium thiostannate | | Ammonium thioantimonate | | Potassium thiocuprate | | Ammonium thioaurate | |
| | Non-treated test piece | No heat treatment | Heat treatment | No heat treatment | Heat treatment | No heat treatment | Heat treatment | No heat treatment | Heat treatment | No heat treatment | Heat treatment | No heat treatment | Heat treatment |
| Coefficient of friction | * | 0.22 | 0.18 | 0.26 | 0.20 | 0.30 | 0.28 | 0.35 | 0.34 | 0.38 | 0.32 | 0.36 | 0.32 |
| Amount of wear (mg) | * | 4 | 1.2 | 6.8 | 3.3 | 12 | 8 | 11 | 11 | 13 | 10 | 15 | 13 |

*The non-treated test piece seized and was unable to be measured.

EXAMPLE 3

Steel plates were subjected to a microcrack plating (the number of cracks: 100/l $cm^2$) under the following conditions:

| Bath components | |
|---|---|
| Chromic anhydride | 200 g/l |
| Sulfuric acid | 1 g/l |
| Sodium silicofluoride | 5 g/l |

The plating was carried out for 30 minutes at a bath temperature of 45° C. at a current density of 20 $A/dm^2$. Then, the plated test pieces were rinsed in water. Then, the test pieces, serving as the positive electrode, were electrolyzed for 30 minutes by D.C. current (current density: 100 $mA/dm^2$) in an aqueous solution of 1% by weight ammonium thiotungstate. Then, the test pieces were rinsed in water and dried at 100° C. for 15 minutes. Then, the test pieces were heat-treated for 30 minutes at 200° to 800° C. in nitrogen gas atmosphere. A static coefficient of friction of the test pieces were measured by the inclination method (the partner material was copper; the load was 10 $g/cm^2$). The results are given in Table 3.

TABLE 3

| | | Treated test pieces | | | | |
|---|---|---|---|---|---|---|
| | Microcrack-plated and non-electrolyzed piece | Non-heated treated piece | Heat treated piece (200° C.) | Heat treated piece (400° C.) | Heat treated piece (600° C.) | Heat treated piece (800° C.) |
| Coefficient of friction | 0.62 | 0.24 | 0.22 | 0.16 | 0.15 | 0.16 |

EXAMPLE 4

2S aluminium plates (size: 1×10×0.1 cm) were prepared as test pieces. The test pieces were degreased by an organic solvent, and then electrolyzed in an aqueous solution of 15% sulfuric acid for 50 minutes at 10° C., using D.C. current (current density: 3 $A/dm^2$), so that an almite film of 50μ was formed on the surface of each test piece. Then, the test pieces were immersed in an aqueous solution of 10% nitric acid for 10 minutes to activate the surface and then were rinsed in water. Then, the test pieces were electrolyzed for 20 minutes by D.C. current (current density: 50 $mA/dm^2$) in aqueous solutions of 1% by weight ammonium thiotungstate, 1% ammonium thioantimonate, 1% ammonium thiostannate, 1% potassium thiocuprate and 1% ammonium thioaurate, respectively. Then, the test pieces were rinsed in water. Then, the test pieces were impregnated with Mo, W, Pb and Sn, respectively, by the alternate immersion method in the following manner:

(a) The Impregnation of Sulfide of Molybdenum

The test pieces were immersed alternately in an aqueous solution of one percent (1%) thimolybdic acid salt and in a sulfuric acid solution for one minute, respectively. After the immersion in 1 N sulfuric acid solution, the test pieces were rinsed in water. This cycle of operation was repeated ten times.

(b) The Impregnation of Sulfide of Tungsten

The test pieces were immersed alternately in an aqueous solution of 1% ammonium thiotungstate and a 1 N sulfuric acid solution for 1 minute, respectively. After the immersion in 1 N sulfuric acid solution, the test pieces were rinsed in water. This cycle of operation was repeated 10 times.

(c) The Impregnation of Sulfide of Tin

The test pieces were immersed alternately in an aqueous solution of 1% ammonium thiostannate and a 1 N sulfuric acid solution for 1 minute, respectively. After the immersion in 1 N sulfuric acid solution, the test pieces were rinsed in water. This cycle of operation was repeated 10 times.

(d) The Impregnation of Lead Sulfide

The test pieces were immersed alternately in an aqueous solution of 5% lead acetate and an aqueous solution of 10% ammonium sulfide for 1 minute, respectively. After the immersion in the ammonium sulfide solution, the test pieces were rinsed in water. This cycle of operation was repeated 10 times.

Then, the test pieces were air-dried and heat-treated at 300° to 500° C. for 30 minutes in nitrogen gas atmosphere. A static coefficient of friction of the test pieces was measured by the inclination method (The partner material was copper: The area of contact was 1 $cm^2$; The load was 2 g). The results are given in Table 4. A static coefficient of friction of the test piece subjected only to the almite treatment was 0.72.

TABLE 4

| Alternate immersion | | Kind of thio-acid metal salt: Ammonium thio-tungstate | Ammonium thio-antimonate | Ammonium thio-stannate | Potassium thio-cuprate | Ammonium thio-aurate |
|---|---|---|---|---|---|---|
| Mo sulfide | no heat treatment | 0.48 | 0.46 | 0.45 | 0.45 | 0.46 |
| Mo sulfide | 300° C. | 0.27 | 0.27 | 0.25 | 0.27 | 0.28 |
| Mo sulfide | 500° C. | 0.26 | 0.25 | 0.23 | 0.24 | 0.23 |
| W sulfide | no heat treatment | 0.53 | 0.50 | 0.53 | 0.51 | 0.51 |
| W sulfide | 300° C. | 0.31 | 0.31 | 0.32 | 0.31 | 0.31 |
| W sulfide | 500° C. | 0.27 | 0.27 | 0.26 | 0.25 | 0.26 |
| Sn sulfide | no heat treatment | 0.51 | 0.54 | 0.53 | 0.50 | 0.53 |
| Sn sulfide | 300° C. | 0.46 | 0.47 | 0.46 | 0.49 | 0.48 |
| Sn sulfide | 500° C. | 0.45 | 0.47 | 0.44 | 0.48 | 0.46 |
| Pd sulfide | no heat treatment | 0.53 | 0.53 | 0.51 | 0.52 | 0.51 |
| Pd sulfide | 300° C. | 0.48 | 0.48 | 0.47 | 0.49 | 0.46 |
| Pd sulfide | 500° C. | 0.48 | 0.45 | 0.47 | 0.46 | 0.46 |

EXAMPLE 5

Test pieces having an almite film were prepared according to the procedure in Example 4. The test pieces were impregnated with Mo sulfide and W sulfide according to the procedure in Example 4. Then, the test pieces were electrolyzed in the aqueous solution of thio-acid metal salt according to the procedure in Example 4. A static coefficient of friction of the test pieces were measured, and the results are given in Table 5.

TABLE 5

| Alternate immersion | | Kind of thio-acid metal salt: Ammonium thio-tungstate | Ammonium thio-antimonate | Ammonium thio-tannate | Potassium thio-cuprate | Ammonium thio-aurate |
|---|---|---|---|---|---|---|
| Mo sulfide | no heat treatment | 0.47 | 0.49 | 0.47 | 0.46 | 0.49 |
| Mo sulfide | 300° C. | 0.26 | 0.27 | 0.25 | 0.27 | 0.28 |
| Mo sulfide | 500° C. | 0.26 | 0.25 | 0.24 | 0.26 | 0.25 |
| W sulfide | no heat treatment | 0.51 | 0.50 | 0.53 | 0.50 | 0.52 |
| W sulfide | 300° C. | 0.31 | 0.31 | 0.33 | 0.32 | 0.33 |
| W sulfide | 500° C. | 0.28 | 0.25 | 0.27 | 0.25 | 0.27 |

EXAMPLE 6

2S aluminum plates (size: 10×10×0.1 cm) were prepared as test pieces. The test pieces were degreased by an organic solvent, and then electrolyzed in an aqueous solution of 15% sulfuric acid for 30 minutes at 10° C., using D.C. current (current density: 3 A/dm$^2$), so that an almite film of 30μ was formed on the surface of each test piece. Then, the test pieces were subjected to the following treatments:

(a) The test pieces were heat-treated at 400° C. for 15 minutes to form cracks on the surface.

(b) Fine cracks were formed on the surface of the test pieces by a honing operation using a grinding stone (#120). Then, the test pieces were rinsed in water and dried.

Then, the test pieces with the almite film were immersed in a solution of 10% nitric acid for ten minutes to activate the surface. Then, the test pieces, serving as the positive electrode, were electrolyzed for 20 minutes by D.C. current (current density: 50 mA/dm$^2$) in aqueous solutions of 1% potassium thioaurate, 1% ammonium thiotungstate, 1% ammonium thiostannate, 1% ammonium thioantimonate and potassium thiocuprate, respectively. Then, the test pieces were rinsed in water and air-dried. Then, a static coefficient of friction of the test pieces was measured by the inclination method. (The partner material was copper; The area of contact was 1 cm$^2$; The load was 2 g). The results are given in Table 6.

TABLE 6

| Enlarging treatment | Kind of thio-acid salt of the secondary electrolysis: Potassium thio- | Ammonium thio- | Ammonium thio- | Ammonium thio- | Potassium thio- |
|---|---|---|---|---|---|
| of the pores | aurate | tungstate | stannate | antimonate | cuprate |
| Non-treated | 0.37 | 0.34 | 0.45 | 0.52 | 0.52 |
| Heat-treated | 0.32 | 0.31 | 0.43 | 0.49 | 0.48 |
| Honing | 0.30 | 0.30 | 0.41 | 0.48 | 0.46 |

The cracks formed by the heat treatment and the honing were filled with the metallic sulfide during the secondary electrolysis, and the surface of the test pieces became smooth. In addition, the amount of impregnation of the metallic sulfide was increased, and therefore a static coefficient of friction became lower.

EXAMPLE 7

2S aluminium plates (size: 10×10×0.1 cm) were degreased by an organic solvent, and then electrolyzed in an aqueous solution of 15% sulfuric acid for 60 minutes at 0° C. at a current density of 4 A/dm$^2$, so that an almite film of 80μ with cracks was formed on the surface of each test piece. Then, the test pieces were rinsed in water and immersed in a solution of 10% nitric acid for ten minutes to activate the surface. Then, the test pieces rinsed in water. Then, the test pieces, serving as the positive electrode, were electrolyzed by D.C. current (current density of 50 mA/dm$^2$) for 40 minutes in aqueous solution of 1% ammonium thiotungstate, respectively. Then, the test pieces were rinsed in water and air-dried. The color of the so-treated test pieces was black, and the cracks were impregnated with the metallic sulfide, produced by the secondary electrolysis, so that the surface became smooth.

EXAMPLE 8

Test pieces were treated according to the procedure in Example 4, but the following pretreatments were carried out before the secondary electrolysis using the aqueous solution of the thio-acid metal salt.

(a) The test pieces were immersed in 5% ammonia water for 5 minutes to enlarge the pores and activate the surface.

(b) The test pieces were immersed in an aqueous solution of 3% sodium carbonate for 5 minutes to enlarge the pores and activate the surface.

(c) The test pieces, serving as the negative electrode, was electrolyzed for 1 minute by D.C. current (current density: 1 A/dm$^2$) in an aqueous solution of 3% sodium carbonate to enlarge the pores and activate the surface.

(d) The test pieces were subjected to vacuum ($10^{-1}$ mmHg) for 30 minutes to activate the surface.

Then, a coefficient of friction of the test pieces were measured. The results are given in Table 7.

TABLE 7

| | Kind of thio-acid salt of the secondary electrolysis | | | | |
|---|---|---|---|---|---|
| Pretreatment | Potassium thio-aurate | Ammonium thio-tungstate | Ammonium thio-stannate | Ammonium thio-antimonate | Potassium thio-cuprate |
| 5% ammonia water | 0.32 | 0.31 | 0.40 | 0.47 | 0.48 |
| 3% sodium carbonate (immersion) | 0.33 | 0.32 | 0.38 | 0.48 | 0.49 |
| 3% sodium carbonate (electrolysis) | 0.30 | 0.30 | 0.40 | 0.46 | 0.47 |
| Evacuation | 0.33 | 0.32 | 0.42 | 0.48 | 0.48 |

EXAMPLE 9

2S aluminium plates (size: 10×10×1.0 cm) were prepared as test pieces. The test pieces were degreased by an organic solvent, and then electrolyzed in an aqueous solution of 15% sulfuric acid for 30 minutes at 10° C. by direct current (current density: 3 A/dm$^2$), so that an almite film of 30μ was formed on the surface of each test piece. Then, the test pieces were rinsed and electrolyzed respectively in the following aqueous solutions of metal salt as a pretreatment.

(a) The test pieces were electrolyzed for 5 minutes at 20° C. by alternating current (15 V) in an aqueous solution of 3% stannous sulfate to which sulfuric acid had been added to adjust the pH to 3.

(b) The test pieces were electrolyzed for 5 minutes by A.C. (20 V) in an aqueous solution of 5% lead acetate.

(c) The test pieces were electrolyzed for 5 minutes by A.C. (15 V) in an aqueous solution of 3% nickel sulfate and 1.5% ammonium sulfate to which boric acid had been added to adjust the pH to 4.5.

(d) The test pieces were electrolyzed for 5 minutes by A.C. (15 V) in an aqueous solution of 3% copper sulfate to which sulfuric acid had been added to adjust the pH to 2.

(e) The test pieces were electrolyzed for 5 minutes by A.C. (15 V) in an aqueous solution of 3% cobalt sulfate.

(f) The test pieces were electrolyzed for 5 minutes by A.C. (10 V) in an aqueous solution of 3% ammonium molybdate.

(g) The test pieces were electrolyzed for 5 minutes by A.C. (10 V) in an aqueous solution of 3% ammonium tungstate.

(h) The test pieces were electrolyzed for 5 minutes by A.C. (10 V) in an aqueous solution of 3% sodium stannate. Then, the test pieces, serving as the positive electrode, were electrolyzed for 10 minutes by D.C. current (current density: 50 mA/dm$^2$) in aqueous solutions of 3% ammonium thiotungstate, 3% ammonium thiostannate and 3% ammonium thioantimonate, respectively. Then, the test pieces were rinsed in water and air-dried. The color tone of the so-treated test pieces and the color tone of the test pieces not subjected to the electrolysis in the aqueous solutions of metal salt were observed, and the results are given in Table 8.

TABLE 8

| | Kind of thio-acid salt | | |
|---|---|---|---|
| Kind of metal salt | Ammonium thiotungstate | Ammonium thiostannate | Ammonium thioantimonate |
| No electrolysis | Dark brown | Brown | Yellow |
| (a) Sn | " | " | " |
| (b) Pb | Black | Black | Black |
| (c) Ni | " | " | " |
| (d) Cu | " | " | " |
| (e) Co | " | " | " |
| (f) Mo | " | Dark brown | Dark brown |
| (g) W | Dark brown | " | " |
| (h) Sn | " | Brown | Brown |

The color tone of the test pieces subjected to the electrolysis in the aqueous solution of the metal salts were darker. It is thought that this is due to the fact that the electro-deposited metal or metal compound produce the metallic sulfide by the electrolysis in the aqueous solution of the thio-acid salt.

EXAMPLE 10

These pieces were treated according to the procedure in Example 9 except for the electrolysis in the aqueous solution of the metal salt. Namely, the test pieces, serving as the positive electrode, were electrolyzed for 5 minutes by direct current (current density: 50 mA/dm$^2$) in aqueous solutions of 3% ammonium molybdate, 3% ammonium tungstate and 3% sodium stannate, respectively. The color tone of the test pieces was observed, and the results are given in Table 9.

TABLE 9

| Kind of | Kind of thio-acid salt | | |
|---|---|---|---|
| metal salt | W | Sn | Sb |
| Mo | Dark brown | Dark brown | Dark brown |
| W | " | " | " |
| Sn | " | " | " |

EXAMPLE 11

The test pieces treated according to the procedure in Example 9 and the test pieces in Example 10 were measured with respect to a static coefficient of friction. Also, the test pieces in Example 9 and the test pieces in Example 10 were heat-treated at 400° C. in nitrogen gas atmosphere, and a static coefficient of friction of the heat-treated test pieces was measured. The measurements were carried out by the inclination method (The partner material was copper; The area of contact was 1

$cm^2$; The load was 2 g). The results are given in Table 10.

TABLE 10

| Current | Kind of metal salt | Kind of thio-acid salt: W, No heat treatment | W, 400° C. | Sn, No heat treatment | Sn, 400° C. | Sb, No heat treatment | Sb, 400° C. |
|---|---|---|---|---|---|---|---|
| A.C. (EXAMPLE 9) | (a) Sn | 0.40 | 0.28 | 0.49 | 0.43 | 0.53 | 0.48 |
| | (b) Pb | 0.37 | 0.29 | 0.47 | 0.42 | 0.51 | 0.47 |
| | (c) Ni | 0.37 | 0.29 | 0.48 | 0.44 | 0.55 | 0.47 |
| | (d) Cu | 0.39 | 0.26 | 0.47 | 0.43 | 0.50 | 0.49 |
| | (e) Co | 0.36 | 0.27 | 0.49 | 0.41 | 0.52 | 0.46 |
| | (f) Mo | 0.38 | 0.24 | 0.45 | 0.36 | 0.57 | 0.35 |
| | (g) W | 0.39 | 0.23 | 0.47 | 0.37 | 0.53 | 0.36 |
| | (h) Sn | 0.38 | 0.24 | 0.49 | 0.42 | 0.53 | 0.44 |
| D.C. (EXAMPLE 10) | Mo | 0.37 | 0.22 | 0.46 | 0.37 | 0.52 | 0.35 |
| | W | 0.36 | 0.25 | 0.47 | 0.37 | 0.50 | 0.33 |
| | Sn | 0.38 | 0.28 | 0.48 | 0.43 | 0.53 | 0.45 |

As is clear from the above, the test pieces treated according to the invention have high lubricating properties. In addition, the test pieces heat-treated at 400° C. have more improved initial lubricating properties.

EXAMPLE 12

2S aluminium plates (size: 10×10×0.1 cm) were prepared as test pieces. The test pieces were degreased by a solvent, and then electrolyzed in an aqueous solution of 15% by weight sulfuric acid for 40 minutes at 10° C. by D.C. (current density: 3 $A/dm^2$), so that an almite film of 40μ was formed on the surface of each test piece. Then, the test pieces were rinsed in water, and immersed in a boiled desalted water for different periods of time, respectively, to semi-seal the pores of the surface of each test piece. Then, the test pieces were immersed in a solution of 10% nitric acid at room temperature for 10 minutes to activate the surface of each test piece. Then, the test pieces were rinsed in water. Then, the test pieces, serving as the positive electrode (the negative electrode was a stainless steel plate), were electrolyzed by D.C. (current density: 30 $mA/dm^2$) in an aqueous solution of 1% ammonium thiotungstate until the electrolyzed product was fully filled in the micropores and began to deposit on the surface of the almite film. Then, the test pieces were rinsed in water and dried. The color tone and static coefficient of friction of the test pieces, having different semi-sealing treatment times, are shown in Table 11 as well as the time required for the secondary electrolysis. The conditions of the measurement of the coefficient of friction were as follows: The partner material was copper; the area of contact was 1 $cm^2$; the load was 2 g.

TABLE 11

| Sealing time | 0 min. | 1 min. | 5 min. | 10 min. | 15 min. |
|---|---|---|---|---|---|
| Time of electrolysis | 30 min. | 25 min. | 12 min. | 5 min. | 3 min. |
| Color tone | Black | Black | Black | Dark brown | Brown |
| Coefficient of friction | 0.35 | 0.37 | 0.35 | 0.40 | 0.37 |

A coefficient of friction of the test piece subjected only to the first electrolysis to have the almite film was 0.63.

EXAMPLE 13

Test pieces were treated according to the procedure in Example 12 except that the test pieces were treated by steam under pressure (3 $kg/cm^2$) for different periods of time, respectively. The results obtained are given in Table 12.

TABLE 12

| Sealing time | 0 min. | 1 min. | 5 min. | 10 min. | 15 min. |
|---|---|---|---|---|---|
| Time of electrolysis | 30 min. | 27 min. | 16 min. | 7 min. | 4 min. |
| Color tone | Black | Black | Black | Dark brown | Dark brown |
| Coefficient of friction | 0.35 | 0.34 | 0.37 | 0.36 | 0.38 |

EXAMPLE 14

Test pieces were treated according to the procedure in Example 12 except that nickel acetate (2%) was dissolved in the boiled water. The results obtained are given in Table 13.

TABLE 13

| Sealing time | 0 min. | 1 min. | 5 min. | 10 min. | 15 min. |
|---|---|---|---|---|---|
| Time of electrolysis | 30 min. | 22 min. | 10 min. | 5 min. | 3 min. |
| Color tone | Black | Black | Black | Black | Dark brown |
| Coefficient of friction | 0.35 | 0.34 | 0.37 | 0.39 | 0.37 |

EXAMPLE 15

Test pieces were treated according to the procedure in Example 12 except that $Na_2Cr_4O_7$ (5%) was dissolved in the boiler water. The results obtained are given in Table 14.

TABLE 14

| Sealing time | 0 min. | 1 min. | 5 min. | 10 min. | 15 min. |
|---|---|---|---|---|---|
| Time of electrolysis | 30 min. | 25 min. | 10 min. | 6 min. | 4 min. |
| Color tone | Black | Black | Black | Black | Dark brown |
| Coefficient of friction | 0.35 | 0.38 | 0.39 | 0.36 | 0.38 |

EXAMPLE 16

Test pieces were treated according to the procedure in Example 12. The test pieces were subjected to a dyeing treatment in a solution of 1% black dye (MLW sold by Sandz) at 70° to 80° C. for 30 minutes. The results obtained are given in Table 15.

TABLE 15

| | |
|---|---|
| Electrolysis time | 5 min. |
| Color tone | Black |
| Coefficient of friction | 0.33 |

EXAMPLE 17

Test pieces were treated according to the procedure in Example 12 except that as a semi-sealing treatment, the test pieces, serving as the electrode, were electrolyzed in an aqueous solution of 5% magnesium sulfate by A.C. at a constant voltage of 5 V to semi-seal the pores. The results obtained are given in Table 16.

TABLE 16

| | | | | |
|---|---|---|---|---|
| Sealing time | 0 min. | 1 min. | 3 min. | 5 min. |
| Time of electrolysis | 30 min. | 22 min. | 15 min. | 9 min. |
| Color tone | Black | Black | Dark brown | Dark brown |
| Coefficient of friction | 0.35 | 0.38 | 0.37 | 0.38 |

EXAMPLE 18

Test pieces were treated according to the procedure in Example 12 except that the test pieces were electrolyzed in an aqueous solution of ammonium thioantimonate at 50°±1° C. The results obtained are given in Table 17.

TABLE 17

| | | | | | |
|---|---|---|---|---|---|
| Sealing time | 0 min. | 1 min. | 5 min. | 10 min. | 15 min. |
| Time of electrolysis | 23 min. | 19 min. | 13 min. | 7 min. | 3 min. |
| Color tone | Black | Dark brown | Dark brown | Dark brown | Brown |
| Coefficient of friction | 0.42 | 0.40 | 0.43 | 0.43 | 0.42 |

EXAMPLE 19

Test pieces were treated according to the procedure in Example 12 except that the test pieces were electrolyzed in an aqueous solution of 1% ammonium thiostannate at room temperature. The results obtained are given in Table 18.

TABLE 18

| | | | | | |
|---|---|---|---|---|---|
| Sealing time | 0 min. | 1 min. | 5 min. | 10 min. | 15 min. |
| Time of electrolysis | 28 min. | 24 min. | 17 min. | 13 min. | 8 min. |
| Color tone | Yellowish brown | Yellowish brown | Brown | Brown | Yellow |
| Coefficient of friction | 0.47 | 0.45 | 0.47 | 0.48 | 0.47 |

EXAMPLE 20

2S aluminium plates, 52S aluminium plates (corrosion-resistant aluminium alloy containing Mg and Si) and 17 aluminium plates (high strength aluminium alloy containing Cu and Si) were prepared as test pieces. The three kinds of test pieces had the size of 1×100×100 mm. The test pieces were electrolyzed in an aqueous solution of sulfuric acid at 20° C. by D.C. (current density: 2 A/dm$^2$) so that anodic oxide films of different thickness (10 μm, 30 μm and 50 μm) were formed on the surfaces of the test pieces. Then, the test pieces were dyed at 80° C. for 30 minutes by an organic black dye ① (the pH of the dyeing solution was 5.5 to 7) and by an organic black dye ② (the pH of the dyeing solution was 3.5 to 5), respectively. Then, the test pieces were activated in an aqueous solution of 10% by volume nitric acid for 1 minute. The test pieces were electrolyzed in an aqueous solution of 0.1% by weight ammonium thiotungstate for 10 minutes by D.C. (current density: 50 mA/dm$^2$). The anodic oxide film served as the positive electrode, and a stainless steel plate as the negative electrode. Then, the test pieces were rinsed in water and dried. 18 test pieces so treated were examined with respect to the dyeing condition and the lubricating properties. The results obtained are given in Table 19. The test pieces not subjected to the above activation treatment in the solution of nitric acid and the test pieces subjected to this treatment were examined. The results are given in Table 20.

TABLE 19

| Aluminium | Thickness of film | Dye | Color uneveness | Color tone | Lubricating properties |
|---|---|---|---|---|---|
| 2S | 10μ | Dye 1 | Δ ~ ○ | Black | ○ |
| | | Dye 2 | x ~ Δ | Bluish black | Δ |
| | 30μ | Dye 1 | ○ | Black | ○ |
| | | Dye 2 | Δ ~ ○ | Bluish black | ○ |
| | 50μ | Dye 1 | ○ | Black | ○ |
| | | Dye 2 | Δ ~ ○ | Black | ○ |
| 52S | 10μ | Dye 1 | ○ | Purplish black | ○ |
| | | Dye 2 | x ~ Δ | Bluish black | Δ |
| | 30μ | Dye 1 | ○ | Black | ○ |
| | | Dye 2 | Δ | Black | Δ |
| | 50μ | Dye 1 | ○ | Black | ○ |
| | | Dye 2 | Δ ~ ○ | Black | ○ |
| 17S | 10μ | Dye 1 | Δ ~ ○ | Reddish black | Δ |
| | | Dye 2 | x ~ Δ | Yellowish black | x |
| | 30μ | Dye 1 | ○ | Reddish black | ○ |
| | | Dye 2 | Δ | Yellowish black | ○ |
| | 50μ | Dye 1 | ○ | Black | ○ |
| | | Dye 2 | Δ | Black | ○ |

TABLE 20

| Aluminium | Thickness of film | Activation (nitric acid) | Dye | Color uneveness | Color tone | Lubricating properties |
|---|---|---|---|---|---|---|
| 2S | 30μ | Not activated | Dye 1 | Δ ~ ○ | Black | ○ |
| | | | Dye 2 | x | Bluish black | Δ |
| | | Activated | Dye 1 | ○ | Black | ○ |
| | | | Dye 2 | Δ ~ ○ | Bluish black | ○ |

(i) In Tables 19 and 20, the dyeing solution using dye 1 had pH of 5.7 and the dyeing solution using dye 2 had pH of 3.7

(ii) The lubricating properties were determined qualitatively by laying tissue paper over the surface and frictionally sliding the paper thereover by the fingers of the examiner.

(iii) The symbols , Δ and x used for indicating the color uneveness and the lubricating properties mean the following:

. . . excellent

Δ . . . good x . . . poor

As is clear from Table 19, the test pieces, which were dyed in the dyeing solutions having pH near the neutrality, and activated, and electrolyzed in the aqueous solution of ammonium thiotungstate, exhibited uniform dyeing and improved lubricating properties. On the other hand, the test pieces, dyed in the dyeing solutions having low pH, exhibited color uneveness and often exhibited poor lubricating properties.

As is clear from Table 20, the test pieces, which were activated after the dyeing treatment, exhibited good dyeing properties and improved lubricating properties.

EXAMPLE 21

2S aluminium plates (size: 10×10×0.1 cm) were prepared as test pieces. The test pieces were degreased by an organic solvent and then electrolyzed in an aqueous solution of 15% sulfuric acid at 10° C. for 20 minutes by D.C. (current density: 3 A/dm$^2$), so that an almite film of 20μ was formed on the surface of each test piece. Then, the test pieces were immersed in an aqueous solution of 10% nitric acid for 10 minutes to activate the surface. Then, the test pieces, serving as the positive electrode, were electrolyzed for 10 minutes by D.C. (current density: 50 mA/dm$^2$) in aqueous solutions of 1% ammonium thioaurate, 1% ammonium thiotungstate, 1% ammonium thiostannate, 1% ammonium thioantimonate and 1% potassium thiocuprate, respectively. Then, the test pieces were rinsed in water and air-dried. Then, the test pieces were subjected to the following treatments, respectively.

(a) The test pieces were immersed in an ethanol solution of 3% stearic acid for five minutes. Then, the test pieces were air-dried.

(b) The test pieces were immersed in liquid paraffin, and then the paraffin was wiped off the test pieces.

(c) Powder (not more than 100μ) of molybdenum sulfide (10% by volume), powder (not more than 100μ) of tungsten sulfide (10% by volume), powder (not more than 100μ) of graphite (10% by volume) and powder (not more than 100μ) of polyfluoroethylene (10% by volume) were dispersed respectively in methyl ethyl ketone solutions of 20% thermosetting epoxy resin to prepare dispersions. The test pieces were immersed in the dispersions, respectively, and then were heated at 180° C. for 20 minutes to set the coating on the surface of each test piece.

(d) Fine powder of molybdenum sulfide, fine powder of tungsten sulfide, and fine powder of graphite were applied, respectively, to the almite films of the test pieces, using buffs of cotton cloth.

A static coefficient of friction of the treated test pieces was measured by the inclination method. The results are given in Table 21.

TABLE 21

| Treatment by lubricating material | Kind of metal salt of electrolytic bath | | | | |
|---|---|---|---|---|---|
| | Ammonium thio-aurate | Ammonium thio-tungstate | Ammonium thio-stannate | Ammonium thio-antimonate | Potassium thio-cuprate |
| No treatment | 0.36 | 0.34 | 0.45 | 0.51 | 0.50 |
| a Stearic acid | 0.30 | 0.29 | 0.31 | 0.31 | 0.29 |
| b Liquid paraffin | 0.32 | 0.31 | 0.32 | 0.33 | 0.32 |
| c $MoS_2$ | 0.29 | 0.28 | 0.28 | 0.29 | 0.30 |
| $WS_2$ | 0.33 | 0.31 | 0.29 | 0.32 | 0.33 |
| Graphite | 0.30 | 0.28 | 0.29 | 0.30 | 0.28 |
| Polyfluoroethylene | 0.33 | 0.32 | 0.32 | 0.34 | 0.32 |
| d $MoS_2$ | 0.19 | 0.20 | 0.20 | 0.18 | 0.19 |
| $WS_2$ | 0.18 | 0.20 | 0.18 | 0.19 | 0.19 |
| Graphite | 0.20 | 0.18 | 0.19 | 0.18 | 0.18 |

EXAMPLE 22

2S aluminium plates (10×10×0.1 cm) were prepared as test pieces. The test pieces were degreased by an organic solvent and then electrolyzed in an aqueous solution of 15% sulfuric acid at 10° C. for 30 minutes at a current density of 3 A/dm$^2$, so that an almite film of 30μ was formed on the surface of each test piece. Then, the test pieces were immersed in an aqueous solution of 10% nitric acid for ten minutes to activate the surface. Then, the test pieces, serving as the positive electrode, were electrolyzed for 20 minutes by D.C. (current density: 50 mA/dm$^2$) in aqueous solutions of 1% ammonium thioaurate, 1% ammonium thiotungstate, 1% ammonium thiostannate, 1% ammonium thioantimonate and 1% potassium thiocuprate, respectively. Then, the test pieces were rinsed in water and air-dried. The test pieces were subjected to a heat treatment at 400° C. for 30 minutes in nitrogen gas atmosphere. The heat-treated test pieces and the test pieces not subjected to the heat treatment were subjected to the following treatments.

(a) The test pieces were subjected to a super finishing by a finishing grinding stone (#1500).

(b) The test pieces were subjected to a buffing operation by a liquid finishing abrasive material, using a buff of cotton cloth.

(c) The test pieces were subjected to a liquid honing by a grinding stone (#500).

A static coefficient of the so-treated test pieces was measured by the inclination method (The partner material was copper; The area of contact was 1 cm$^2$; the load was 2 g). The results are given in Table 22.

TABLE 22

| Treatment | Kind of thio-acid salt in electrolytic bath | | | | |
|---|---|---|---|---|---|
| | Ammonium thio-aurate | Ammonium thio-tungstate | Ammonium thio-stannate | Ammonium thioanti-monate | Potassium thio-cuprate |
| No heat treatment no finishing | 0.34 | 0.34 | 0.45 | 0.48 | 0.50 |
| No heat treatment super finishing | 0.20 | 0.21 | 0.25 | 0.28 | 0.27 |
| No heat treatment buffing | 0.22 | 0.19 | 0.26 | 0.30 | 0.29 |
| No heat treatment honing | 0.21 | 0.20 | 0.28 | 0.29 | 0.30 |
| Heat treatment no finishing | 0.27 | 0.28 | 0.40 | 0.45 | 0.44 |
| Heat treatment super finishing | 0.15 | 0.13 | 0.23 | 0.25 | 0.24 |
| Heat treatment buffing | 0.12 | 0.13 | 0.20 | 0.19 | 0.22 |
| Heat treatment honing | 0.14 | 0.13 | 0.19 | 0.22 | 0.22 |

EXAMPLE 23

2S aluminium plates (10×10×0.1 cm) were prepared as test pieces. The test pieces were degreased, and then electrolyzed in an aqueous solution of 15% by weight sulfuric acid at 10° C. for 30 minutes by D.C. (current density: 3 A/dm$^2$), so that an anodic oxide film was formed on the surface of each test piece. Then, the test pieces were adequately rinsed in water. Then, the test pieces were electrolyzed in an aqueous solution of 0.1% by weight ammonium thiotungstate by D.C. (current density: 50 mA/dm$^2$) at a constant current for 15 minutes. The anodic oxide film served as the positive electrode while a stainless steel plate (10×20×0.1 cm) served as the negative electrode. Then, the test pieces were rinsed in water. Then, the test pieces were dried for one hour at temperatures of between room temperature and 200° C. Then, the surface of each test piece was rubbed lightly with JK wiper (cellulose paper sold by Jujo Kimberley). After this rubbing treatment, a dynamic coefficient of friction of the test pieces was measured by a surface measuring device, HEIDON-14 (the partner material was SCM 5; the load was 1 kg/cm$^2$; the speed was 5 cm/min.). The results obtained are given in Table 23. Also, a comparison test piece, which was not subjected to the secondary electrolysis in the aqueous solution of ammonium thiotungstate, was prepared. The comparison test piece was rinsed in water after the almite film was formed, and then was dried at 100° C. for one hour. The same measurement was carried out with respect to this non-treated comparison test piece. The results are also given in Table 23.

TABLE 23

| | Comparison test piece | Test pieces of the present invention | | | | |
|---|---|---|---|---|---|---|
| Drying temperature | 100° C. | Air dried | 50° C. | 100° C. | 150° C. | 200° C. |
| Before rubbing | 0.56 | 0.41 | 0.42 | 0.38 | 0.37 | 0.38 |
| After rubbing | 0.54 | 0.27 | 0.25 | 0.27 | 0.24 | 0.25 |

EXAMPLE 24

Test pieces were treated according to the procedure in Example 23 except that the rubbing treatment was carried out, using cotton cloth instead of the JK wiper. A dynamic coefficient of friction of the test pieces subjected to the rubbing treatment was measured. The results are given in Table 24. A comparison test piece prepared according to the procedure in Example 23 was also measured, and the results are given in Table 24.

TABLE 24

| | Comparison test pieces | Test pieces of the present invention | | | | |
|---|---|---|---|---|---|---|
| Drying temperature | 100° C. | Air-dried | 50° C. | 100° C. | 150° C. | 200° C. |
| Dynamic coefficient of friction | 0.57 | 0.28 | 0.25 | 0.27 | 0.26 | 0.25 |

As is clear from Tables 23 and 24, the test pieces, subjected to the rubbing treatment by the JK wiper and the cotton cloth, exhibited lower dynamic coefficient of friction and more improved lubricating properties than the non-treated comparison test pieces.

EXAMPLE 25

Natural scaly $MoS_2$ with a particle size of not more than 100μ and atomized aluminium powder (particle size: not more than 100μ) were mixed together. $MoS_2$ was mixed with the aluminium powder in such an amount that the first resultant mixture had 1% by volume $MoS_2$. Also, $MoS_2$ was mixed with the aluminium powder in such an amount that the second resultant mixture had 5% by volume $MoS_2$. The first and second mixtures were compression-molded, and the resultant moldings were sintered at 620° C. for 3 hours to prepare test pieces (70 mmϕ×10 m). Similarly, other aluminium composites were prepared as test pieces, using additive components of $WS_2$, PbS, graphite, graphite fluoride, BN and $Al_2O_3$, respectively, as described above for $MoS_2$. The particle size of the additive components were not more than 100μ. The first mixtures had 1% by volume additive components, and the second mixtures had 5% by volume additive components, as described above for $MoS_2$. Then, all of the test pieces were electrolyzed in an aqueous solution of 15% by weight sulfuric acid at 10° C. for 30 minutes by superposed A.C. and D.C. current (D.C. current density: 3 A/dm$^2$), so that an almite film of 30 to 40μ was formed on the surface of each test piece. Then, the test pieces, serving as the positive electrode, were electrolyzed for 20 minutes by D.C. (current density: 50 mA/dm$^2$) in aqueous solutions of 1% by weight ammonium thiotungstate, 1% ammonium thiostannate, 1% ammonium thioantimonate and 1% potassium thiocuprate, respectively. After this secondary electrolysis, the test pieces were rinsed in water and air-dried. Then, the test pieces were heat-treated at 400° C. for 30 minutes in nitrogen gas atmosphere. Then, a static coefficient of friction of the test pieces was measured by the inclination method (The partner material was copper; The area of contact was 1 cm$^2$; The load was 2 g). The results are given in Table 25.

TABLE 25

| Aluminium composite | Kind of thio-acid salt of secondary electrolysis | | | |
|---|---|---|---|---|
| | Ammonium thiotungstate | Ammonium thiostannate | Ammonium thioantimonate | Potassium thiocuprate |
| 1% $MoS_2$ before 2nd electrolysis | 0.39 | 0.39 | 0.39 | 0.39 |
| 1% $MoS_2$ after 2nd electrolysis | 0.35 | 0.39 | 0.38 | 0.40 |
| 1% $MoS_2$ after heat treatment | 0.21 | 0.30 | 0.35 | 0.34 |
| 1% $WS_2$ before 2nd electrolysis | 0.41 | 0.41 | 0.41 | 0.41 |
| 1% $WS_2$ after 2nd electrolysis | 0.32 | 0.39 | 0.41 | 0.40 |
| 1% $WS_2$ after heat treatment | 0.21 | 0.31 | 0.37 | 0.36 |
| 1% PbS before 2nd electrolysis | 0.56 | 0.56 | 0.56 | 0.56 |
| 1% PbS after 2nd electrolysis | 0.35 | 0.48 | 0.50 | 0.52 |
| 1% Pbs after heat treatment | 0.28 | 0.38 | 0.45 | 0.47 |
| 1% graphite before 2nd electrolysis | 0.43 | 0.43 | 0.43 | 0.43 |
| 1% graphite after 2nd electrolysis | 0.29 | 0.39 | 0.43 | 0.44 |
| 1% graphite after heat treatment | 0.19 | 0.33 | 0.40 | 0.39 |
| 1% graphite fluoride before 2nd electrolysis | 0.40 | 0.40 | 0.40 | 0.40 |
| 1% graphite fluoride after 2nd electrolysis | 0.33 | 0.38 | 0.42 | 0.39 |
| 1% graphite fluoride after heat treatment | 0.23 | 0.34 | 0.39 | 0.35 |
| 1% BN before 2nd electrolysis | 0.44 | 0.44 | 0.44 | 0.44 |
| 1% BN after 2nd electrolysis | 0.35 | 0.40 | 0.44 | 0.43 |
| 1% BN after heat treatment | 0.24 | 0.34 | 0.39 | 0.40 |
| 1% $Al_2O_3$ before 2nd electrolysis | 0.68 | 0.68 | 0.68 | 0.68 |
| 1% $Al_2O_3$ after 2nd electrolysis | 0.35 | 0.47 | 0.55 | 0.52 |
| 1% $Al_2O_3$ after | 0.29 | 0.39 | 0.48 | 0.49 |

TABLE 25-continued

| Aluminium composite | Kind of thio-acid salt of secondary electrolysis | | | |
|---|---|---|---|---|
| | Ammonium thio-tungstate | Ammonium thio-stannate | Ammonium thio-antimonate | Potassium thio-cuprate |
| heat treatment | | | | |
| 5% $MoS_2$ after heat treatment | 0.19 | 0.22 | 0.27 | 0.23 |
| 5% $WS_2$ after heat treatment | 0.17 | 0.24 | 0.23 | 0.22 |
| 5% PbS after heat treatment | 0.25 | 0.35 | 0.40 | 0.40 |
| 5% graphite after heat treatment | 0.15 | 0.25 | 0.24 | 0.25 |
| 5% graphite fluoride after heat treatment | 0.18 | 0.26 | 0.27 | 0.27 |
| 5% BN after heat treatment | 0.22 | 0.27 | 0.29 | 0.26 |
| 5% $Al_2O_3$ after heat treatment | 0.27 | 0.42 | 0.49 | 0.50 |

("%" denotes % by volume.)

EXAMPLE 26

Test pieces were treated according to the procedure in Example 25 except that the test pieces were prepared by dispersing natural $MoS_2$, $WS_2$, PbS, graphite, graphite fluoride, BN, $Al_2O_3$ in molten aluminium, respectively, and casting the molten aluminium. The particle size of the additive components was not more than 100μ. The additive components were added in such an amount that the resultant molten aluminium had 1% by volume respective additive components. A static coefficient of friction of the test pieces was measured. The results are given in Table 26.

TABLE 26

| Aluminium composite | Kind of thio-acid salt of secondary electrolysis | | | |
|---|---|---|---|---|
| | Ammonium thio-tungstate | Ammonium thio-stannate | Ammonium thio-antimonate | Potassium thio-cuprate |
| $MoS_2$ after heat treatment (400° C.) | 0.22 | 0.27 | 0.33 | 0.32 |
| $WS_2$ after heat treatment (400° C.) | 0.19 | 0.30 | 0.35 | 0.36 |
| PbS after heat treatment (400° C.) | 0.27 | 0.38 | 0.47 | 0.44 |
| Graphite after heat treatment (400° C.) | 0.19 | 0.32 | 0.37 | 0.36 |
| Graphite fluoride after heat treatment (400° C.) | 0.21 | 0.35 | 0.39 | 0.37 |
| BN after heat treatment (400° C.) | 0.23 | 0.35 | 0.38 | 0.36 |
| $Al_2O_3$ after heat treatment (400° C.) | 0.29 | 0.42 | 0.46 | 0.45 |

EXAMPLE 27

Aluminium alloys (10×10×0.5 cm), containing 5% Mo, 5% W, 5% Pb, 5% Sn, 20% Mo, 20% W, 20% Pb and 20% Sn, respectively, were prepared as test pieces. The test pieces were electrolyzed in an aqueous solution of 15% sulfuric acid at 10° C. for 30 minutes by superposed A.C. and D.C. current (D.C. current density: 3 A/dm$^2$; A.C. current density: 1 A/dm$^2$), so that an almite film of 30μ was formed on the surface of each test piece. Then, the test pieces, serving as the positive electrode, were electrolyzed by D.C. (current density 50 mA/dm$^2$) in an aqueous solution of 1% by weight ammonium thiotungstate, 1% ammonium thiostannate, 1% ammonium thioantimonate and 1% potassium thiocuprate, respectively. Then, the test pieces were rinsed in water and air-dried. The test pieces were heat-treated at 400° C. for 30 minutes in nitrogen gas atmosphere. A static coefficient of friction was measured with respect to the so treated test pieces and the test pieces not subjected to the heat treatment, using the inclination method. The results are given in Table 23. 2S aluminium plates (10×10×0.1 cm) were treated in the manner described above to prepare the comparison test pieces. The results are also given in Table 27.

TABLE 27

| | Kind of metal salt of secondary electrolysis | | | |
|---|---|---|---|---|
| | Ammonium thio-tungstate | Ammonium thio-stannate | Ammonium thio-antimonate | Potassium thio-cuprate |
| 2S Al before heat treatment | 0.35 | 0.47 | 0.50 | 0.52 |
| 2S Al after heat treatment | 0.25 | 0.41 | 0.48 | 0.47 |
| 5% Mo alloy before heat treatment | 0.32 | 0.40 | 0.41 | 0.38 |
| 5% Mo alloy after heat treatment | 0.24 | 0.31 | 0.32 | 0.31 |
| 20% Mo alloy before heat treatment | 0.31 | 0.42 | 0.40 | 0.40 |
| 20% Mo alloy after heat treatment | 0.19 | 0.30 | 0.30 | 0.28 |
| 5% W alloy before heat treatment | 0.31 | 0.38 | 0.40 | 0.39 |
| 5% W alloy after heat treatment | 0.22 | 0.32 | 0.30 | 0.33 |
| 20% W alloy before heat treatment | 0.29 | 0.39 | 0.41 | 0.37 |
| 20% W alloy after heat treatment | 0.23 | 0.30 | 0.29 | 0.29 |
| 5% Pb alloy before heat treatment | 0.33 | 0.49 | 0.52 | 0.50 |
| 5% Pb alloy after heat treatment | 0.26 | 0.36 | 0.42 | 0.41 |
| 20% Pb alloy before heat treatment | 0.34 | 0.47 | 0.48 | 0.49 |
| 20% Pb alloy after heat treatment | 0.25 | 0.33 | 0.38 | 0.37 |
| 5% Sn alloy before heat treatment | 0.32 | 0.44 | 0.45 | 0.44 |
| 5% Sn alloy after heat treatment | 0.23 | 0.30 | 0.32 | 0.32 |
| 20% Sn alloy before heat treatment | 0.32 | 0.42 | 0.43 | 0.44 |
| 20% Sn alloy after heat treatment | 0.21 | 0.27 | 0.30 | 0.28 |

EXAMPLE 28

Sintered alumina plates (100×100×5 mm) with a porosity of 15% were activated by tin chloride and sensitized by palladium chloride. Then, the test pieces of sintered alumina was subjected to an electroless nickel plating so that the film or coating of 0.5μ was formed on each test piece. Then, the test pieces, serving as the positive electrode, were electrolyzed for 10 minutes by D.C. (current density: 20 mA/dm$^2$) in aqueous solution of 1% ammonium thiotungstate and 1% ammonium thiostannate, respectively. Then, the test pieces were rinsed in water and air-dried. Then, the test pieces were heat-treated in nitrogen gas atmosphere at 800° C. for 30 minutes. A static coefficient of friction of the test pieces was measured by the inclination method (The partner material was copper; The load was 10 g/cm$^2$). The results are given in Table 28.

TABLE 28

| | Non-treated alumina | Ammonium thiotungstate | | Ammonium thiostannate | |
|---|---|---|---|---|---|
| | | No heat treatment | Heat treatment | No heat treatment | Heat treatment |
| Coefficient of friction | 0.72 | 0.39 | 0.33 | 0.45 | 0.38 |

What is claimed is:

1. A method of the surface treatment of a porous material which comprises the step of electrolyzing the porous material in an electrolytic bath composed of an aqueous solution of at least one salt selected from the group consisting of alkali metal thiotungstate, alkali metal thioantimonate, alkali metal thiostannate, alkali metal thiocuprate, alkali metal thioarsenate, alkali metal thioaurate, alkali metal thioplatinate, alkali metal thioniobate, alkali metal thiovanadate, alkaline earth metal thiotungstate, alkaline earth metal thioantimonate, alkaline earth metal thiostannate, alkaline earth metal thiocuprate, alkaline earth metal thioarsenate, alkaline earth metal thioaurate, alkaline earth metal thioplatinate, alkaline earth metal thioniobate, alkaline earth metal thiovanadate, ammonium thiotungstate, ammonium thioantimonate, ammonium thiostannate, ammonium thiocuprate, ammonium thioarsenate, ammonium thioaurate, ammonium thioplatinate, ammonium thioniobate and ammonium thiovanadate, to thereby impregnate the porous material with the metallic sulfide.

2. A method according to claim 1, in which after the electrolysis, the porous material is immersed alternately in an aqueous solution of at least one metal salt of thioacid prepared as described above for the electrolytic bath and an acid aqueous solution to impregnate the porous material with the metallic sulfide.

3. A method according to claim 1 or claim 2, in which the porous material is subjected to a heat treatment at a final stage.

4. A method according to claim 1 or 2, in which the porous material is a sintered metal, a metal product with an anodic oxide film, a porous chromium plated or microcrack plated metal, a ceramic or plastic material treated by a porous chromium plating or a microcrack plating after subjected to an electroless plating, an aluminium composite containing lubricating particles, or an aluminium alloy containing lubricating material and having an anodic oxide film.

5. A method according to claim 4, in which said lubricating particles are $MoS_2$, $WS_2$, PbS, graphite, graphite fluoride or BN.

6. A method according to claim 4, in which said lubricating material is Mo, W, Pb or Sn.

7. A method according to claim 1 or claim 2, in which before the electrolysis, the porous material is immersed in an acid aqueous solution as a pretreatment.

8. A method according to claim 1 or claim 2, in which before the electrolysis, the porous material is immersed in an alkaline aqueous solution as a pretreatment.

9. A method according to claim 1 or claim 2, in which before the electrolysis, the porous material is additionally electrolyzed as a pretreatment in an aqueous solution of at least one salt of metal selected from the group of nickel, tin, copper, manganese, cadmium, titanium, chronium, zinc, silver, gold and vanadium, or in an aqueous solution of at least one salt of oxyacid selected from the group consisting of molybdic acid, tungstic acid and stannic acid.

10. A method according to claim 1 or claim 2, in which before the electrolysis, the pores in the surface of the porous material are enlarged as a pretreatment.

11. A method according to claim 10, in which the enlarging treatment is carried out by electrolyzing the porous material by D.C. in an alkaline aqueous solution, the porous material serving as the negative electrode.

12. A method according to claim 10, in which the enlarging treatment is carried out by honing.

13. A method according to claim 10, in which the enlarging treatment is carried by subjecting the porous material to subatmospheric pressure or vacuum.

14. A method according to claim 1 or claim 2, in which the porous material is a metal product having an anodic oxide film, the pores in the anodic film being reduced in size as a pretreatment before the electrolysis.

15. A method according to claim 14, in which the size-reducing treatment is carried out by immersing the porous material in hot or boiled desalted water.

16. A method according to claim 15, in which at least one of nickel acetate, bichromate and silicate of soda is dissolved in the desalted water.

17. A method according to claim 15, in which an organic dye is dissolved in the desalted water.

18. A method according to claim 14, in which the size-reducing treatment is carried out by subjecting the metal product with the anodic oxide film to steam under pressure.

19. A method according to claim 1 or claim 2, in which the porous material is dyed by an organic dye as a pretreatment.

20. A method according to claim 3, in which the heat treatment is carried out at 200° to 800° C. in the absence of oxygen.

21. A method according to claim 1 or claim 2, in which after the porous material is impregnated with the metallic sulfide, the porous material is subjected to a drying and dehydrating treatment.

22. A method according to claim 1 or claim 2, in which after the porous material is impregnated with the metallic sulfide, the porous material is treated by lubricating material.

23. A method according to claim 22, in which the lubricating material is fatty acids.

24. A method according to claim 22, in which the lubricating material is lubricating oils.

25. A method according to claim 22, in which the lubricating material is solid lubricant.

26. A method according to claim 25, in which the solid lubricant is fine powder of $MoS_2$, $WS_2$, graphite, BN or polyfluoroethylene.

27. A method according to claim 1 or claim 2, in which after the porous material is impregnated with the metallic sulfide, the surface of the porous material is subjected to a grinding treatment.

28. A method according to claim 1 or claim 2, in which after the porous material is impregnated with the metallic sulfide, the surface of the porous material is subjected to a rubbing treatment.

29. A method according to claim 27, in which the grinding treatment is carried out by a buff, a grinding stone or a cutter.

30. A method according to claim 1 or claim 2, in which the concentration of the electrolytic bath is 0.01 to 30% by weight.

31. A method according to claim 30, in which a water-soluble organic solvent or a surface active agent is added to the electrolytic bath or the immersion solution.

32. A method according to claim 2, in which the acid aqueous solution is an aqueous solution of inorganic acid, organic acid or salt thereof.

* * * * *